United States Patent [19]

Banks

[11] Patent Number: 5,073,030

[45] Date of Patent: Dec. 17, 1991

[54] DRUM APPARATUS FOR MIXING ASPHALT COMPOSITIONS

[76] Inventor: Edgar N. Banks, 9121 S. Shrout Rd., Grain Valley, Mo. 64029

[21] Appl. No.: 469,949

[22] Filed: Jan. 25, 1990

[51] Int. Cl.[5] ..... B28C 5/20

[52] U.S. Cl. ..... 366/25; 366/40; 366/57

[58] Field of Search ..... 366/22, 23, 24, 25, 366/15, 40, 38, 54, 56, 57, 58, 59, 62, 63, 228, 229, 235; 34/132, 15, 136, 137, 128, 129; 432/108, 109, 110, 111, 118, 14, 112, 113

[56] References Cited

U.S. PATENT DOCUMENTS

| | | | |
|---|---|---|---|
| Re. 31,904 | 6/1985 | Mendenhall . | |
| Re. 31,905 | 6/1985 | Mendenhall . | |
| 1,836,754 | 12/1931 | Hepburn . | |
| 2,049,734 | 8/1936 | Fasting | 432/109 X |
| 2,290,765 | 7/1942 | Overman | 34/135 X |
| 2,319,673 | 5/1943 | French | 432/108 X |
| 2,421,345 | 5/1947 | McConnaughay . | |
| 2,618,865 | 11/1952 | Arnold | 34/128 |
| 3,674,242 | 7/1972 | Stewart . | |
| 3,705,711 | 12/1972 | Seelandt et al. . | |
| 3,866,888 | 2/1975 | Dyzyk . | |
| 4,039,171 | 8/1977 | Shearer . | |
| 4,075,710 | 2/1978 | Jakob et al. | 366/25 |
| 4,095,284 | 6/1978 | Mendenhall . | |
| 4,147,436 | 4/1979 | Garbelman et al. . | |
| 4,165,184 | 8/1979 | Schlarmann . | |
| 4,174,181 | 11/1979 | Garbelman et al. . | |
| 4,177,575 | 12/1979 | Brooks | 34/129 X |
| 4,190,370 | 2/1980 | Brock et al. . | |
| 4,207,062 | 6/1980 | Moench et al. . | |
| 4,211,490 | 7/1980 | Brock et al. | 366/25 X |
| 4,262,429 | 4/1981 | Avril . | |
| 4,298,287 | 11/1981 | McCarter, III et al. . | |
| 4,307,520 | 12/1981 | Lutz . | |
| 4,318,619 | 3/1982 | Schlarmann . | |
| 4,318,620 | 3/1982 | Malipier . | |
| 4,332,478 | 6/1982 | Binz | 366/25 X |
| 4,361,406 | 11/1982 | Loggins, Jr. et al. . | |
| 4,395,129 | 6/1983 | Musil . | |
| 4,427,376 | 1/1984 | Etnyre et al. . | |
| 4,450,287 | 9/1985 | Servas et al. . | |
| 4,481,039 | 11/1984 | Mendenhall . | |
| 4,585,354 | 4/1986 | Thesenfitz . | |
| 4,600,379 | 7/1986 | Elliott | 366/25 X |
| 4,787,938 | 11/1988 | Hawkins . | |
| 4,797,002 | 1/1989 | Heap | 366/25 |

*Primary Examiner*—Harvey C. Hornsby
*Assistant Examiner*—Scott J. Haugland
*Attorney, Agent, or Firm*—Hovey, Williams, Timmons & Collins

[57] ABSTRACT

In a dryer apparatus including an elongated rotatable drum having an input end and an output end, a burner for directing hot gases into the input end of the drum, and an aggregate feed mechanism for supplying aggregate particles into the drum adjacent the input end and for conveying the aggregate particles toward the output end, an assembly adapted to introduce reclaimed asphalt pavement particles into the dryer includes an inner drum for introducing reclaimed asphalt pavement particles into the elongated drum at a position adjacent the output end of the elongated drum and for moving the recycled asphalt pavement particles within the elongated drum in a direction counter to the direction of flow of the hot gases so that the hot gases heat the recycled asphalt pavement particles during travel of the recycled asphalt pavement particles within the inner drum assembly. The inner drum is mounted for rotation with the elongated drum and has an inlet end, an outlet end, and flighting for moving the recycled asphalt pavement along the inner drum from the inlet end toward the outlet end such that recycled asphalt pavement falls from the outlet end of the inner drum into the elongated drum and mixes with aggregate particles which are introduced into the drum adjacent the input end. The particles are heated by the hot gases moving in and around the inner drum as well as by conduction heating carried out via the flighting within the inner drum.

14 Claims, 3 Drawing Sheets

DRUM APPARATUS FOR MIXING ASPHALT COMPOSITIONS

BACKGROUND OF THE INVENTION

1. Field of the Invention

The present invention relates generally to an apparatus for heating and mixing asphalt-aggregate composition and, more particularly, to an assembly for use with such an apparatus to introduce reclaimed asphalt pavement particles into the apparatus for heating and mixing with virgin aggregate particles.

2. Discussion of the Prior Art

It is known to carry out hot-mix recycling of reclaimed asphalt pavement by either a batch or drum-mix recycling process. In drum-mix plants, reclaimed asphalt pavement (RAP) is introduced into a rotatable drum downstream of a burner flame and mixes with super-heated new aggregate particles which enter the drum adjacent the flame at the inlet of the drum. In this manner, it is possible to distance the RAP from the flame in order to reduce "blue smoke", an environmental problem arising from exposing the RAP to relatively high temperatures, e.g. greater than about 275 degrees Fahrenheit.

Typically, a dense veil of virgin aggregate particles are showered in front of the entering RAP particles in order to further shield the RAP particles from exposure to the flame. In other known constructions, mechanical shields are provided to carry out a similar function with the goal of reducing "blue smoke" to an acceptable level.

Certain drawbacks exist with each of these known constructions. For example, if the aggregate particles are used as a shield for the RAP particles, then special flighting is required within the drum or additional inlet openings are required to direct virgin material into the path of the flame to prevent exposure of the RAP particles to the flame. Further, where mechanical shields are used, supplementary hardware is required in addition to the hardware used to introduce the RAP particles into the drum in order to convert an existing drum plant into a plant capable of recycling RAP. Thus, such constructions are expensive to install and tend to render the plant less efficient than would be the case if the heat from the flame were more fully utilized in the heating process.

OBJECTS AND SUMMARY OF THE INVENTION

It is an object of the present invention to provide a drum apparatus for heating and mixing asphalt-aggregate composition which permits recycling of RAP while minimizing or eliminating "blue smoke" characteristic of such devices known in the art.

Another object of the invention is to provide an asphalt-aggregate heating and mixing apparatus in which RAP or other additive is introduced into the drum and heated gradually during movement in a counter-flow direction through the drum so that the hot gases within the drum are used efficiently to preheat the RAP prior to mixing of the RAP with the heated virgin aggregate.

Yet a further object of the invention is to provide an assembly for use in an apparatus for heating and mixing asphalt-aggregate composition, wherein the assembly permits the apparatus to be used in recycling RAP without producing unacceptable levels of "blue smoke" and can be installed easily and inexpensively into an existing apparatus originally constructed without the capacity for carrying out such recycling operations or in which such recycling operations typically produce "blue smoke".

Pursuant to these and other objects of the invention, an assembly is provided which is adapted to introduce reclaimed asphalt pavement particles into a dryer apparatus including an elongated rotatable drum having an input end and an output end, means for supplying hot gases to the drum at the input end and for directing the hot gases toward the output end, means for supplying aggregate particles into the drum adjacent the input end and for conveying the aggregate particles toward the output end, and means for introducing reclaimed asphalt pavement particles into the drum.

In accordance with one aspect of the invention, the assembly includes an inner drum for introducing reclaimed asphalt pavement particles into the drum at a position adjacent the output end of the elongated drum and for moving the recycled asphalt pavement particles within the elongated drum in a direction counter to the direction of flow of the hot gases so that the hot gases heat the recycled asphalt pavement particles during travel of the recycled asphalt pavement particles within the inner drum assembly. The inner drum is mounted for rotation with the elongated drum and has an inlet end, an outlet end, and means for moving the recycled asphalt pavement along the inner drum from the inlet end toward the outlet end such that recycled asphalt pavement falls from the outlet end of the inner drum into the elongated drum and mixes with aggregate particles which are introduced into the drum adjacent the input end.

Preferably, the inner drum is conical shaped with the inlet end being smaller than the outlet end, and the means for moving the recycled asphalt pavement particles along the inner drum includes flighting within the inner drum which extends radially inward from the drum. Mounting means are provided in the assembly for mounting the inner drum within the elongated drum in an orientation collinear with the elongated drum, the inner drum being formed of a diameter which is smaller than the diameter of the elongated drum so that the hot gases passing within the elongated drum pass both within and around the inner drum.

BRIEF DESCRIPTION OF THE DRAWING FIGURES

A preferred embodiment of the invention is described in detail below with reference to the attached drawing figures, wherein.

DETAILED DESCRIPTION OF THE PREFERRED EMBODIMENT

Figure 1:
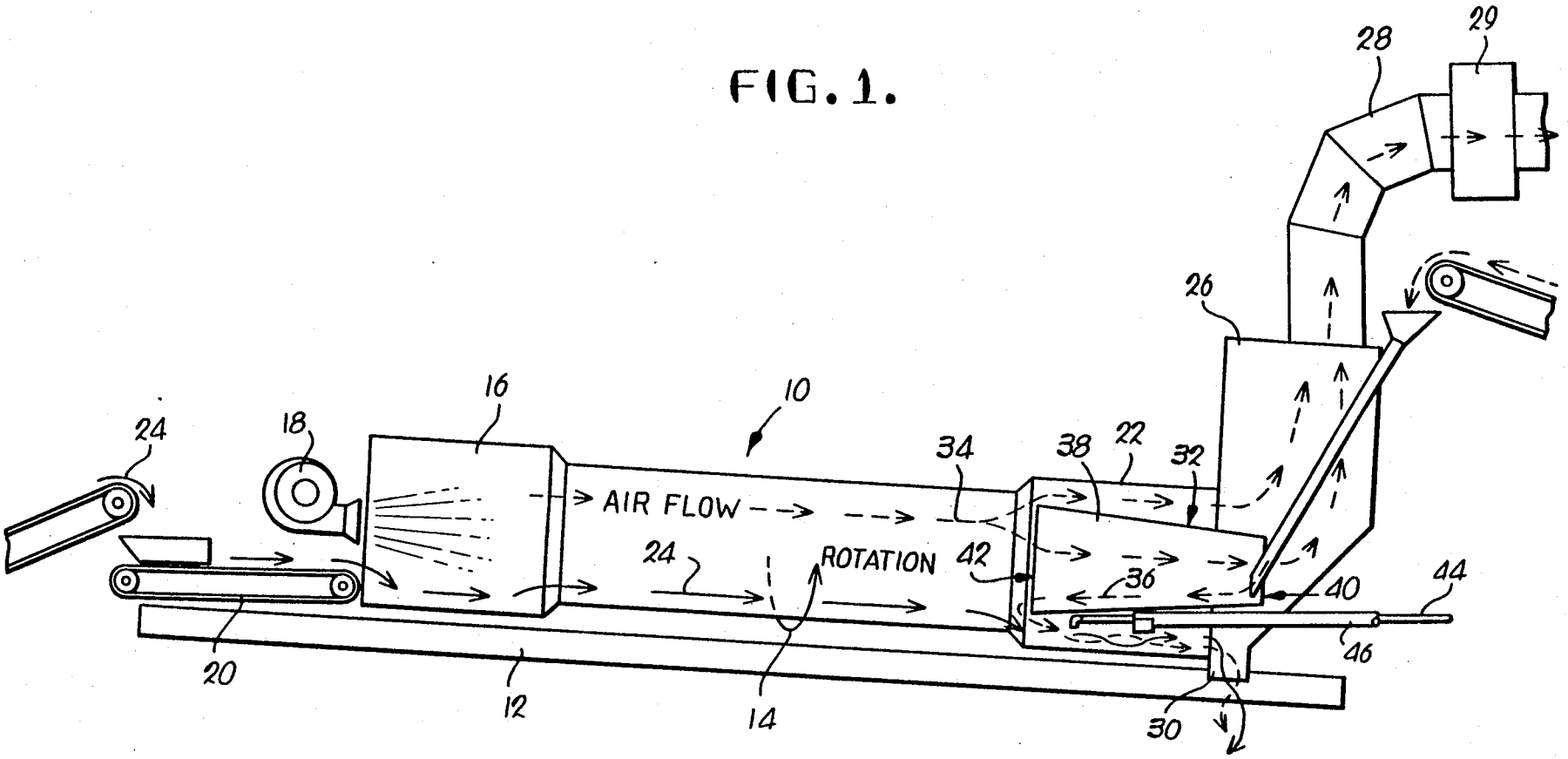
FIG. 1 is a schematic side elevation view of an apparatus for heating and mixing asphalt-aggregate composition constructed in accordance with the present invention.

An apparatus for heating and mixing asphalt-aggregate composition constructed in accordance with the present invention is illustrated in FIG. 1, and includes an elongated, flighted drum 10 which is mounted in a conventional manner on a support structure 12 for rotation in the direction shown by arrow 14.

At an input end 16 of the flighted drum 10, a burner 18 is provided which directs a flame into the drum to provide hot gases which are utilized in drying and heating asphalt aggregate particles fed to the drum via an inlet conveyor 20 or the like. Flights, which are not shown in the drawing figures, are provided within the drum 10 to move the aggregate particles along the interior of the drum toward an output end 22 thereof, as indicated by the solid-line arrows 24, and to carry out mixing of the particles during the heating process. It is noted that although the arrows 24 indicate that the aggregate particles move axially through the drum 10, the particles, in fact, are continuously agitated within the drum and move along a circuitous path during travel therethrough.

A stationary outlet structure 26 is provided on the support structure 12 and cooperates with the drum 10 to define an air chamber adjacent the output end 22 of the drum into which the exhaust gases from the heating process pass after exiting the drum. These exhaust gases pass from the chamber through a duct 28 to a bag house or the like 29 where dust is filtered from the air prior to release of the air to the atmosphere. An outlet opening 30 is provided in the outlet structure 26 through which hot-mixed aggregate composite is delivered from the drum 10 to be stored until such time as the composite is to be used.

An inner drum assembly 32 is provided in accordance with the present invention for introducing RAP particles into the elongated drum 10 at a position adjacent the output end 22 of the elongated drum and for moving the recycled asphalt pavement particles within the elongated drum in a direction counter to the direction of flow of the hot gases so that the hot gases heat the recycled asphalt pavement particles during travel of the recycled asphalt pavement particles within the interior of the elongated drum 10. As shown in FIG. 1, the direction of movement of the hot gases within the elongated drum 10 is indicated by the short dashed arrows 34 while the direction of movement of the RAP particles is illustrated by the long-dashed arrows 36.

The inner drum assembly 23 includes an inner drum 38 mounted for rotation with the elongated drum 10 and having an inlet end 40, an outlet end 42, and means for moving the recycled asphalt pavement along the inner drum from the inlet end toward the outlet end during rotation of the inner drum 38 such that recycled asphalt pavement particles moving along the inner drum fall from the outlet end 42 into the elongated drum 10 and mix with the aggregate particles that are introduced into the drum 10 adjacent the input end 16.

The inner drum 38 is preferably formed of a conical shape having a small inlet end which extends beyond the output end 22 of the elongated drum 10, and a large outlet end which is disposed within the drum 10 intermediate the input and output ends 16, 22 of the elongated drum. By constructing the inner drum 38 in this manner, numerous advantageous results are achieved. For example, by providing the inner drum 38 with a relatively large outlet end 42, it is possible to direct a large portion of the hot gases into the inner drum 38 to heat the RAP particles during travel of the particles within the inner drum. In addition, some of the hot gases also pass around the outlet end of the inner drum and along the outer surface of the drum so as to heat the drum and the flights therein, thus further facilitating heating and drying of the RAP particles within the inner drum.

Another benefit which is realized through the use of the conical inner drum construction resides in the inherent ability of the conical drum 38 to assist in moving RAP particles from the inlet end 40 toward the outlet end 42 during rotation of the drums 10, 38. Also, an inlet pipe 44 is provided for feeding liquid asphalt into the elongated drum 10 and is disposed within the elongated drum adjacent the outer surface of the inner drum 38 so that the inner drum serves as a shield for protecting the outlet of the pipe 44 from direct exposure to the hot gases within the elongated drum 10. Thus, the liquid asphalt is permitted to mix with the heated aggregate composition at a sheltered location within the elongated drum.

A screw conveyor 46 or the like may also be provided in the elongated drum 10 adjacent the pipe 44 for conveying bag-house dust, mineral filler and/or other dry materials into the elongated drum 10 for mixing with the composition. This conveyor 46 is also protected from the flame within the elongated drum by the wall of the inner drum 38.

Figure 2:
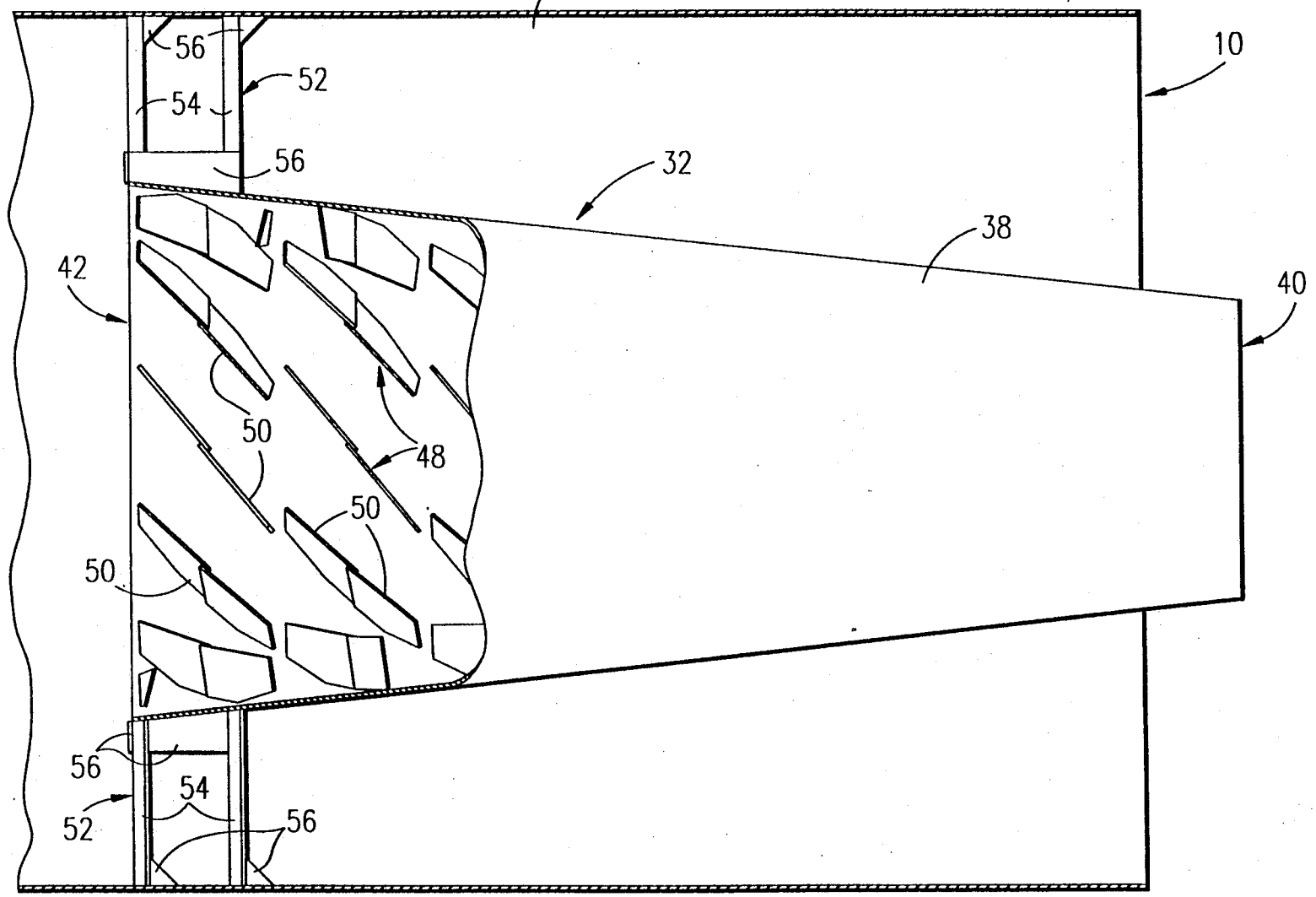
FIG. 2 is a partial side elevation view, partially in section, of the inner drum assembly of a heating and mixing apparatus constructed in accordance with the invention.

Turning to FIG. 2, the inner drum 38 is shown as including a plurality of flight sections 48 which are secured to the inner surface of the drum 38 in such a way as to direct material from the inlet end 40 toward the outlet end 42 of the drum. In addition, each of the flight sections 48 are preferably separated from one another in order to facilitate mixing of the particles within the drum during rotation thereof and to improve heat transfer between the flights and the particles.

Figure 3:
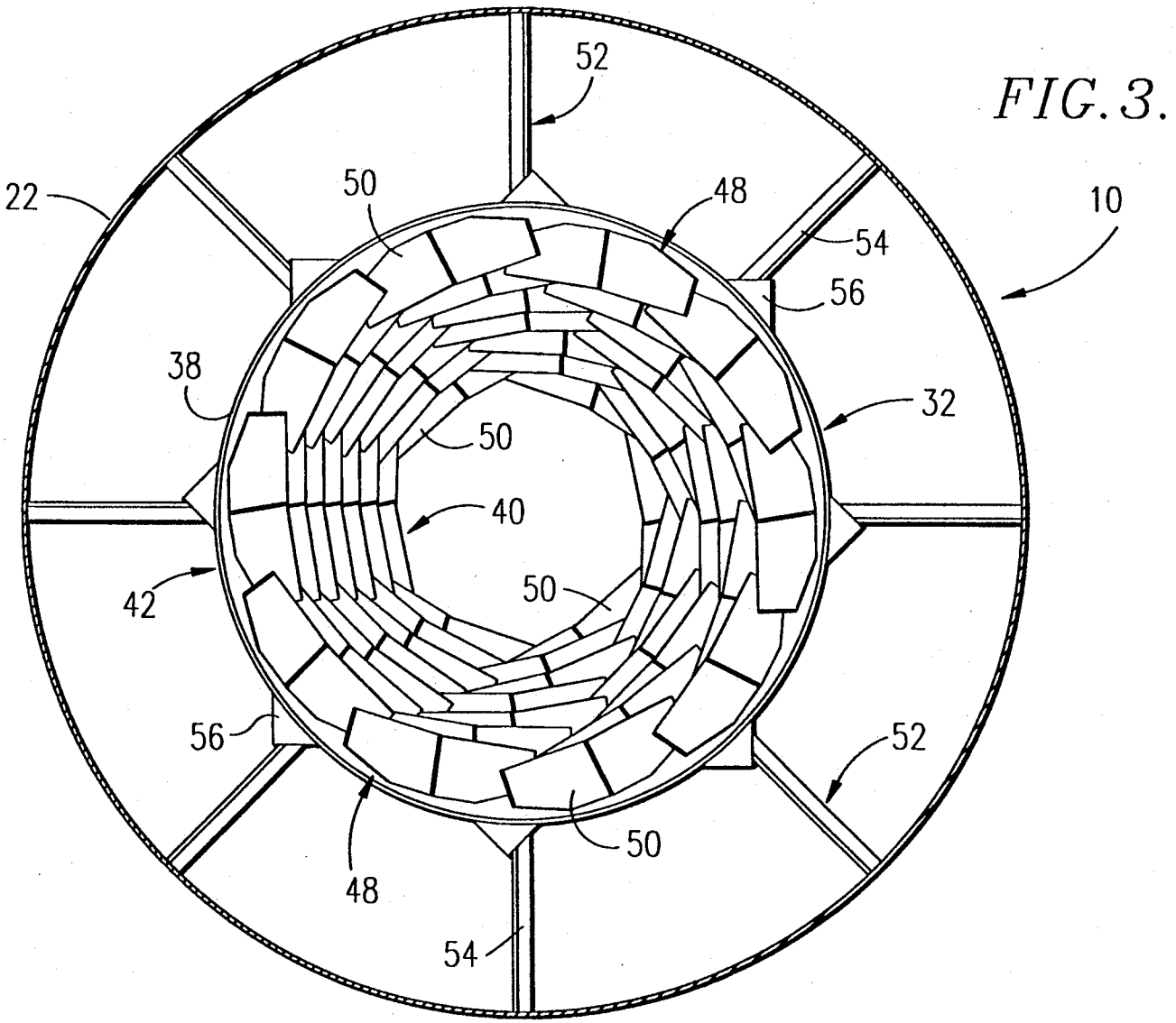
FIG. 3 is an end view of the inner drum assembly taken at the outlet end of the inner drum.

As shown in FIG. 3, a number of radially extending support assemblies 52 extend between the inner drum 38 and elongated drum 10 and retain the inner drum in the elongated drum for rotation therewith. Each support assembly 52 includes a pair of spaced L-shaped bars 54 extending between the outer surface of the inner drum 38 and the inner surface of the elongated drum 10. Reinforcement members 56 are attached between the L-shaped bars adjacent each of the drums 10, 38 to rigidify the support assemblies. Although no support assemblies are illustrated as being employed adjacent the inlet end 40 of the inner drum 38, it is understood that any means for supporting the inner drum within the elongated drum may be used without deviating from the present invention.

Although the invention has been described with reference to the illustrated preferred embodiment, it is intended that substitutions may be made and equivalents employed herein without departing from the scope of the invention as recited in the claims.

What is claimed is:

1. In an apparatus for heating and mixing asphalt-aggregate composition including an elongated rotatable drum having an input end and an output end, means for supplying hot gases to the drum at the input end and for directing the hot gases toward the output end, and means for supplying aggregate particles into the drum adjacent the input end and for conveying the aggregate particles toward the output end, the improvement comprising:

feeding means for introducing recycled asphalt pavement particles into the drum at a position adjacent the output end of the elongated drum and for moving the recycled asphalt pavement particles within the elongated rum in a direction counter to the direction of flow of the hot gases so that the hot gases heat the recycled asphalt pavement particles during travel of the recycled asphalt pavement particles within the elongated drum, the feeding means including an inner drum mounted for rotation with the elongated drum and having an inlet end, an outlet end disposed intermediate the input and output ends of the elongated drum, and means for moving the recycled asphalt pavement along the inner drum from the inlet end toward the outlet end during rotation of the inner drum such that recycled asphalt pavement particles moving along the inner drum fall from the outlet end of the inner drum into the elongated drum and mix with the aggregate particles that are introduced into the drum adjacent the input end, the mixed recycled asphalt pavement particles and aggregate particles moving together in a direction parallel to the direction of flow of the hot gases toward the output end of the elongated drum; and introduction means for introducing liquid asphalt cement into the drum at a position downstream of the outlet end of the inner drum in the direction of travel of the hot gases.

2. The apparatus as recited in claim 1, wherein the inner drum is conical shaped with the inlet end of the inner drum being smaller that the outlet end.

3. The apparatus as recited in claim 1, wherein the means for moving the recycled asphalt pavement particles along the inner drum from the inlet end toward the outlet end includes flighting within the inner drum which extends radially inward from the inner drum.

4. The apparatus as recited in claim 1, wherein the inlet end of the inner drum is disposed outside the output end of the elongated drum.

5. The apparatus as recited in claim 1, further comprising mounting means for mounting the inner drum within the elongated drum and collinear with the elongated drum, the inner drum being formed of a diameter which is smaller than the diameter of the elongated drum so that the hot gases passing within the elongated drum pass both within and around the inner drum.

6. The apparatus as recited in claim 1, further comprising means for removing the hot gases from the elongated drum and from the inner drum at the output end of the elongated drum and for filtering dust from the air prior to releasing the air to atmosphere.

7. The apparatus as recited in claim 6, further comprising means for introducing the dust collected from the air back into the elongated drum at a position downstream of the outlet end of the inner drum in the direction of travel of the hot gases.

8. An apparatus for heating and mixing asphalt-aggregate composition comprising:

a stationary support structure;

an elongated drum mounted for rotation on the support structure and including an input end and an output end;

heating means for introducing hot gases into the drum at the input end, the hot gases passing through the drum toward the output end;

means for introducing aggregate particles into the drum adjacent the input end so that the aggregate particles are exposed to and heated by the hot gases;

an inner drum assembly for introducing recycled asphalt pavement particles into the drum at a position adjacent the output end of the elongated drum and for moving the recycled asphalt pavement particles within the elongated drum in a direction counter to the direction of flow of the hot gases, the inner drum assembly including an inner drum mounted for rotation with the elongated drum and having an inlet end, an outlet end disposed intermediate the input and output ends of the elongated drum, and means for moving the recycled asphalt pavement particles along the inner drum from the inlet end toward the outlet end, the recycled asphalt pavement particles falling from the outlet end of the inner drum into the elongated drum and mixing with the aggregate particles that are introduced into the drum adjacent the input end, the mixed recycled asphalt pavement particles and aggregate particles moving together in a direction parallel to the direction of flow of the hot gases toward the output end of the elongated drum; and introduction means for introducing liquid asphalt cement into the drum at a position downstream of the outlet end of the inner drum in the direction of travel of the hot gases.

9. The apparatus as recited in claim 8, wherein the inner drum is conical shaped with the inlet end of the inner drum being smaller than the outlet end.

10. The apparatus as recited in claim 8, wherein the means for moving the recycled asphalt pavement particles along the inner drum from the inlet end toward the outlet end includes flighting within the inner drum which extends radially inward form the inner drum.

11. The apparatus as recited in claim 8, wherein the inlet end of the inner drum is disposed outside the output end of the elongated drum.

12. The apparatus as recited in claim 8, further comprising mounting means for mounting the inner drum within the elongated drum and collinear with the elongated drum, the inner drum being formed of a diameter which is smaller than the diameter of the elongated drum so that the hot gases passing within the elongated drum pass both within and around the inner drum.

13. The apparatus as recited in claim 8, further comprising means for removing the hot gases from the elongated drum and from the inner drum at the output end of the elongated drum and for filtering dust from the air prior to releasing the air to atmosphere.

14. The apparatus as recited in claim 13, further comprising means for introducing the dust collected from the air back into the elongated drum at a position downstream of the outlet end of the inner drum in the direction of travel of the hot gases.

* * * * *